US006497131B1

(12) United States Patent
Feijen

(10) Patent No.: US 6,497,131 B1
(45) Date of Patent: Dec. 24, 2002

(54) APPARATUS FOR STEPWISE BENDING OF SHEET METAL PIECES OR SIMILAR MATERIAL

(75) Inventor: Hendricus Hubertus Feijen, Lanaken (BE)

(73) Assignee: Acera S.A., Luxemburg (LU)

( * ) Notice: Subject to any disclaimer, the term of this patent is extended or adjusted under 35 U.S.C. 154(b) by 144 days.

(21) Appl. No.: 09/641,287

(22) Filed: Aug. 17, 2000

(30) Foreign Application Priority Data

Dec. 3, 1999 (EP) ..... 99124175

(51) Int. Cl.[7] ..... B21D 11/18; B21D 13/02
(52) U.S. Cl. ..... 72/297; 72/385
(58) Field of Search ..... 72/296, 297, 385, 72/381, 311, 305

(56) References Cited

U.S. PATENT DOCUMENTS 3,628,369 A * 12/1971 Williamson ..... 72/385
3,768,294 A * 10/1973 Van Dijk ..... 72/307
5,819,578 A * 10/1998 Codatto ..... 72/379.2

FOREIGN PATENT DOCUMENTS

| | | | |
|---|---|---|---|
| AU | 246185 | * 12/1960 | ..... 72/385 |
| DE | 198 02 589 A1 | 7/1999 | |
| JP | 44-19141 | * 8/1969 | ..... 72/385 |
| JP | 56 039124 | 4/1981 | |
| JP | 04 028421 | 1/1992 | |
| WO | 99/37417 | 7/1999 | |

* cited by examiner

*Primary Examiner*—Daniel C. Crane
(74) *Attorney, Agent, or Firm*—Pearne & Gordon LLP

(57) ABSTRACT

An apparatus for stepwise bending of sheet metal strips into trapeze-shaped pieces comprises a vice set on each side of a press punch and opposed lower-side pressure cylinder arranged to grip a central portion of the metal strip and deform it in a vertical direction as the end portions of the metal strip are retained in the vice sets. Each vice set comprises an upper-side pressure cylinder including an upper vice plate and an opposed lower-side die including a lower vice plate arranged upon closing movement to grip the end portion of the metal strip extending therebetween. Each of the vice plates is movable in a horizontal direction to accommodate the vertical deformation of the metal strip.

9 Claims, 2 Drawing Sheets

APPARATUS FOR STEPWISE BENDING OF SHEET METAL PIECES OR SIMILAR MATERIAL

BACKGROUND OF THE INVENTION AND RELATED ART

The present invention concerns an apparatus for bending sheet metal pieces or sheet metal strips into a trapeze-like shape or other shapes useful in industrial applications.

An apparatus of the type of concern is shown in DE 198 02 589 A1 and WO 99/37471. This known apparatus, designed to perform bending operations, is comprised of dies and attached to them upper-side pressure cylinders moveable horizontally in the machine positioned before and after the lower-side pressure cylinder with its corresponding press punch in order to ensure tension-free length reduction in the sheet metal piece during the bending operation. It has been found that the horizontal sliding arrangement of the dies and their corresponding pressure cylinders leads to a more complicated and costly design of the apparatus. Another problem with this known apparatus for stepwise bending is its relatively low speed of operation.

An objective of the present invention is the provision of an apparatus, of the type mentioned above, that is simpler, and, therefore, its development is less costly and more economical. Additionally, this apparatus should operate at higher speed.

This objective is achieved by an apparatus, satisfying characteristics of the principal concepts recited in the patent claim 1, is developed.

Further development and improvements of the invention are subject of subsequent claims of this patent.

SUMMARY OF THE INVENTION

The use of the vice plates, which move in the horizontal direction and function to secure in place sheet metal pieces for bending operation, make it possible to provide the apparatus with a very robust design. Additionally, when needed, replacement of the moveable vice plates is economical.

This design makes it possible to increase the speed of the stepwise process when the strip material is bent, as well as the process throughput, approximately 10 times.

According to the invention, adjustment cylinders serve primarily to return the vice plates, after each step of the bending process, back to their initial horizontal position. When the adjustment cylinders are designed with dual-side action, they can be used at least to sustain horizontal movements caused by the bending process.

In cases where the dies of the bending apparatus can move independently in the vertical direction, the apparatus can be utilized for multiple purposes because it can bend different shapes, e.g., trapeze-like shapes, and it is simpler to remove the trapeze-like section from the apparatus, especially, if the shape of the bent section is asymmetric.

BRIEF DESCRIPTION OF THE DRAWINGS

These and other objects and advantages of the invention will become more apparent from the following detailed description and drawings in which.

DETAILED DESCRIPTION OF THE DRAWINGS

Figure 1:
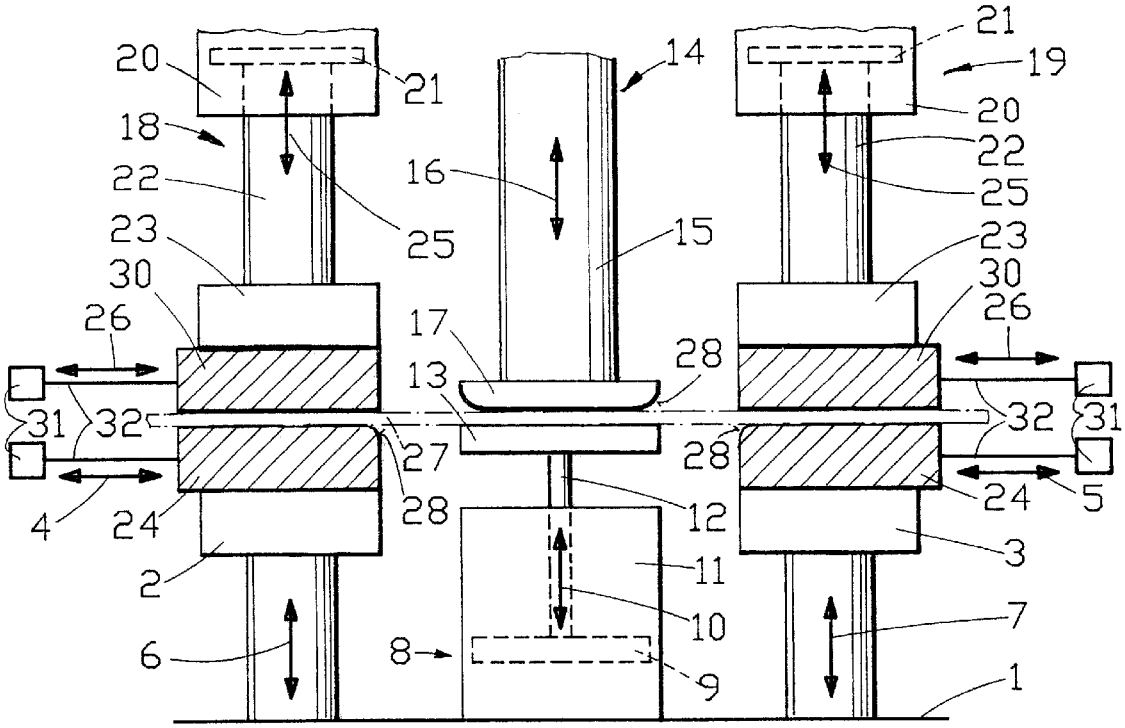
FIG. 1 is a side view of an apparatus for stepwise bending of sheet metal strips according to the invention, the functional elements of the apparatus being shown in their initial positions before the bending operation of a sheet metal piece is started.

On a bed plate 1, which serves as apparatus foundation, two dies 2 and 3 are installed or mounted at a fixed lateral or sideways distance from each other. The dies 2 and 3 are separately controlled and can be moved in vertical direction, as indicated by vertical double arrows 6 and 7.

The vertical movement of the dies 2 and 3 may be provided, for example, through the use of a hydraulic cylinder (not shown), especially a cylinder with a dual-side action.

Besides the dies 2 and 3, a pressure cylinder 8 is attached to the bed plate 1. The pressure cylinder, located between the dies 2 and 3, is positioned at fixed distances from them. The pressure cylinder 8 houses a separately controlled piston 9, that can be moved vertically along an axis, as double arrow 10 indicates.

The pressure cylinder 8 has a housing 11 from which a piston rod 12, of the piston 9, protrudes. At the outer end of the piston rod 12, a counterpressure plate 13 is attached.

The two dies 2 and 3, as well as the pressure cylinder 8 can be operated independently and, therefore, their vertical movement can be controlled separately. A press cylinder 14, positioned above the pressure cylinder 8, has an attached press punch 15, which is also operated separately in the vertical direction and can be moved along the axis of the pressure cylinder 8, as double arrow 16 indicates.

At the lower end of the press punch 15 and opposite to the counterpressure plate 13 of the pressure cylinder 8, a pressure plate 17 is attached. The pressure plate 17 operates with the counterpressure plate 13 of the pressure cylinder 8 in the manner described below.

Above each of the dies 2 and 3, pressure cylinders 18 and 19 are positioned. Each pressure cylinder 18 and 19 has a housing 20 in which a piston 21 moves along an axis. The piston rod 22, that can move out of the housing 20, at its outer end, has a pressure plate 23 opposite to the dies 2 and 3, respectively.

The pistons 21 of the pressure cylinders 18 and 19 can move in and out of the cylinders along their longitudinal axis, as indicated by a vertical double arrow 25.

Upon each die 2 and 3 a vice plate 24 is installed in such way that it can be shifted in a horizontal direction, as indicated by double arrows 4 and 5.

On the lower side of the pressure plate 23, of respective cylinders 18 and 19, and opposite to the dies 2 and 3, another vice plate 30 is installed in such way that it can be shifted in horizontal direction, as indicated by double arrows 26.

The vice plates 24 and 30, positioned on the dies 2 and 3, and, respectively, on the pressure plates 23 of the pressure cylinders 18 and 19, can be shifted horizontally in any desired way. Nonetheless, a glide bearing is preferred in order to achieve the desired effect with vice plates by maintaining the required pressure on the surfaces of the parts moving toward each other as minimal as possible.

Although it is sufficient for functional capability of the apparatus, according to the invention, that vice plates 24 and 30, positioned on the dies 2 and 3, and against the pressure cylinders 18 and 19, can move freely in horizontal direction, each vice plate is provided with an adjustment device, preferably, a dual-action hydraulic adjustment cylinder. Each adjustment cylinder 31 is attached to a respective vice plate 24 or 30 using connector 32 (detailed view is not shown) that is preferably a mechanical linking element.

Figure 2:
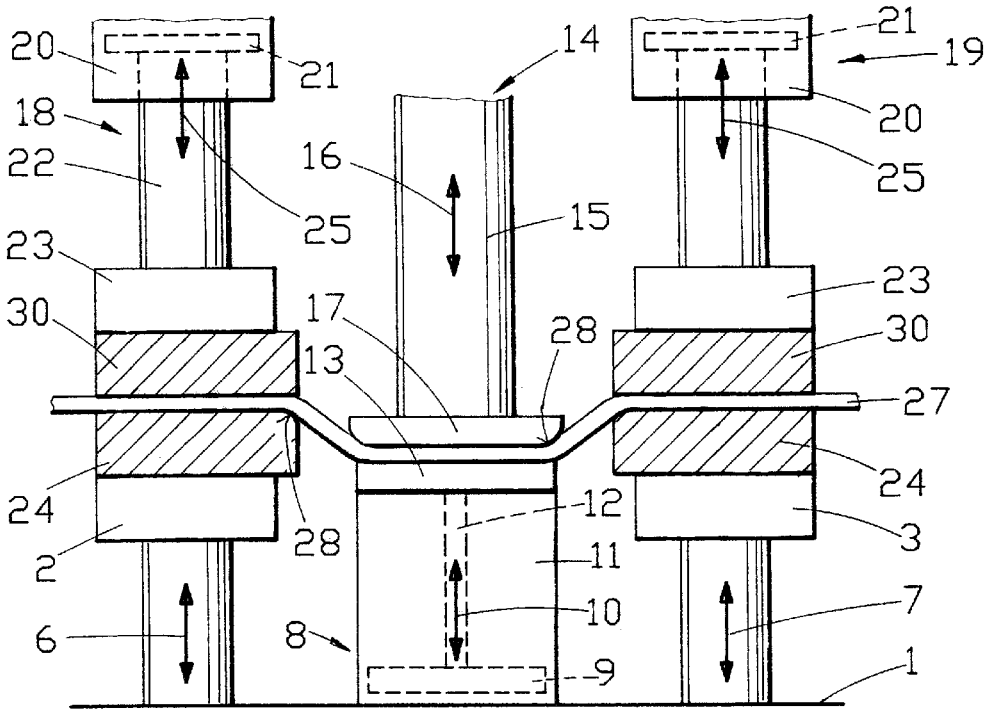
FIG. 2 is a view similar to FIG. 1, wherein the sheet metal piece is shown being bent into a trapeze-like shape during the next step of the bending operation.
Figure 3:
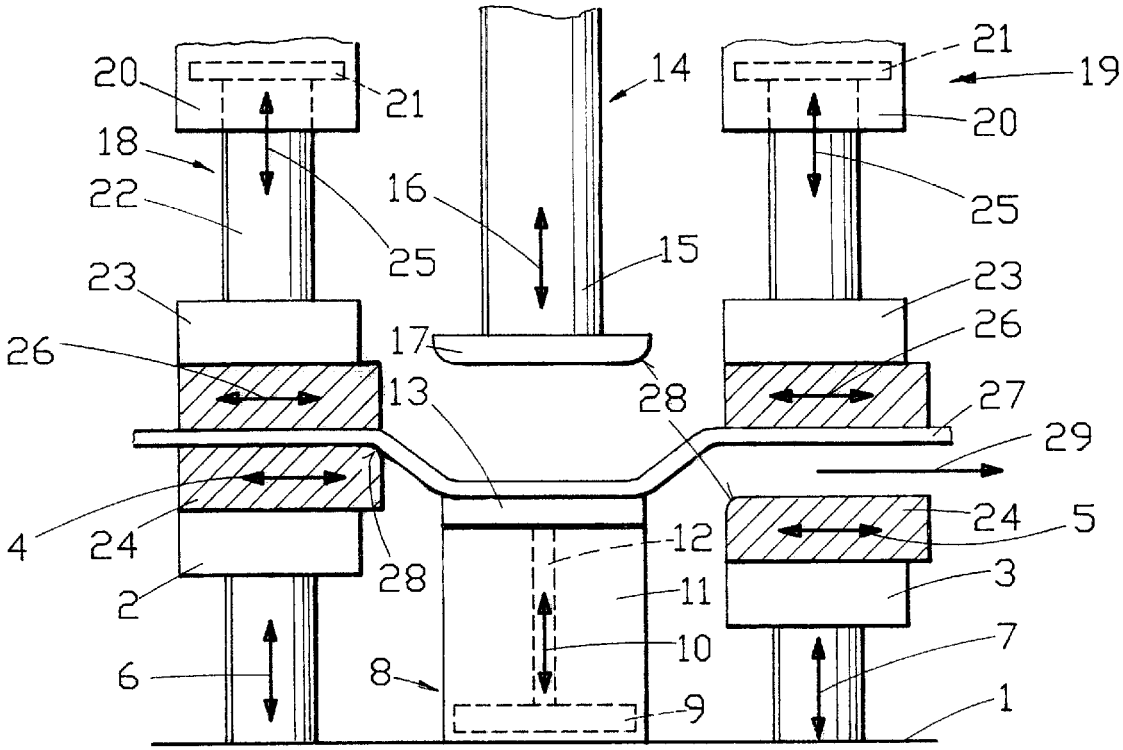
FIG. 3 is a view similar to FIGS. 1 and 2, wherein the upper-side press punch is withdrawn, after the bending process is finished, and one of the dies is moved down to allow the bent sheet metal to be removed from the bending apparatus on the right side; at the same time, the vice plates in the area of another die are disengaged from each other to allow movement of the sheet metal piece.

In the embodiment shown in FIGS. 1 through 3, the pressure plate 17 as well as vice plates 24 have their edges 28 rounded to conform to the metal sheet piece 27 bending radius. The counterpressure plate 13, and respective vice plates 23 do not need to have such rounded edges because bending of the strip material, in this case pieces 27, does not occur in this area. The pressure plate 17 and vice plates 24 can be replaced, if a different bending radius or profile must be used for the strip material, in this case pieces 27.

In order to perform bending of a material into a trapeze-like shape, a piece of a flat strip material, in this case piece 27, is pushed into the open apparatus (according to FIG. 1), and placed in the position required for bending. Further, the dies 2 and 3 as well as pressure cylinders 18 and 19, are moved out in order to secure the section of the flat strip material (in this case piece 27) between the vice plates 24 of the dies 2 and 3, and between the vice plates 30 of the pressure cylinders 18 and 19. At the same time, or following the previous step, the counterpressure plate 13 of the pressure cylinder 8, as well as the pressure plate 17 of the press punch 15, are also brought into position from above and beneath in order to grasp the sheet metal strip (piece 27) and secure it on both sides.

Afterwards, the press punch 15 is moved out further and, at the same time, piston 9 of the pressure cylinder 8 is withdrawn in order to begin bending the area of the piece 27 between the dies 2 and 3, as indicated on FIG. 2. As a result, the piece 27 is bent into a trapeze-like shape as shown on FIG. 2. The bending of the piece 27 occurs over the rounded edges 28 of the pressure plate 17, as well as over the edges of vice plates 24, in such a way that the piece 27 is protected, and therefore, the bending process is performed without a significant deep-draw effect.

In order to compensate, without stretching, the shortening of the piece 27 resulting from bending, the vice plates 24 and 30, attached to the dies 2 and 3, as well as to the pressure cylinders 18 and 19, are moved in the direction indicated by double arrows 4, 5 and 26.

Since the sections of the piece 27 between the respective vice plates are held freely, these sections retain their initial shape and, therefore, form straight flanks of the trapeze-like profiled piece 27.

Although movement of the vice plates 24 and 30 occurs without supply of power, it is preferred that this movement is controlled accurately and individually by adjustment cylinder 31 or at least sustained by this cylinder.

Following completion of the stepwise bending process of the sheet metal piece 27, moveable parts of the bending apparatus return to the initial position, as indicated in FIG. 1, and make the sheet metal piece available for the next step of the process. At this stage, the die 3 returns to its position, as shown in FIG. 3, to create a condition when the trapeze-shaped section of the sheet metal piece 27 can be moved out of the apparatus bending area in the direction indicated by arrows 29, and, thus, the metal sheet piece 27 is moved forward from left to right, as seen in FIG. 3, ensuring that the apparatus is ready for the next bending cycle. The next stepwise bending cycle occurs as previously described.

Figure 4:
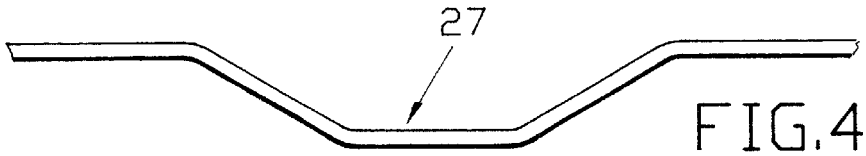
FIGS. 4, 5 and 6 are elevational views showing various trapeze-like shapes which can be produced using the apparatus according to FIGS. 1 through 3.
Figure 5:
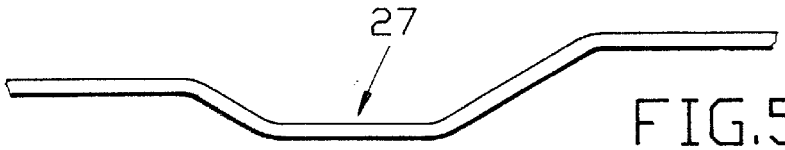
Figure 6:
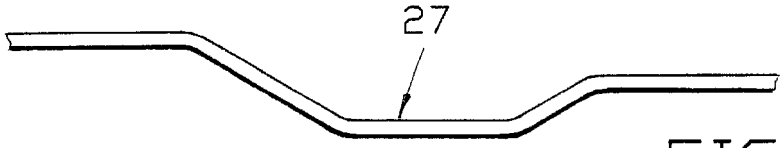

Since in the bending apparatus, according to the invention, the dies 2 and 3 and operating jointly with them pressure cylinders 18 and 19, as well as pressure cylinder 8 and operating jointly with it press cylinder 14, are moved and controlled separately and individually, capability-is created to produce trapeze-shaped pieces that have various depths and asymmetrical profiles, as shown in FIGS. 4 through 6. These trapeze-shaped cross-sections can be produced from the bent strip material or sheet metal material, where the outer ends extend to the half height of the bent piece, in the middle or other areas of this piece, as shown in FIGS. 5 and 6.

A certain interest presents usage of this type of cross-sections as connectors for profile rods or profile supports where the trapeze-shaped crosspieces are required. The design of this type of profile rod or support is characterized by welded-in connectors, i.e., the trapeze-shaped connectors, made out of strip material, are welded in-between the straps of non deformed strip material.

In order to perform the bending operation, three segments of the sheet metal piece 27, during each step of the process, are secured and, through joint operation of the vice plates, the sheet metal piece 27 is deformed into a trapeze-shaped piece. The inclined flanks of the trapeze are not deformed, they remain as straight as adjacent areas of the sheet metal piece. Preceding description of the bending apparatus, according to the invention, explained the bending process to produce the downward-pointed trapeze-shaped segments. The bending apparatus can produce the upward-pointed trapeze-shaped segments as well. In this case, the pressure plate 17 and the counterpressure plate 13, and, also, the vice plates 24 and 30, respectively, must be exchanged with each other.

What is claimed is:

1. An apparatus for the stepwise bending of sheet metal strips into pieces having a trapeze-like shape or any other industrially usable shape comprises a horizontal bed plate foundation, a lower-side pressure cylinder supported on said bed plate and having a piston, arranged for axial movement in a direction perpendicular to said horizontal bed plate, a press punch moveable in an axial direction relative to said lower-side pressure cylinder, said lower-side pressure cylinder and press punch being arranged to grip and deform said metal strip extending therebetween, and first and second vice sets, one of said vice sets being laterally positioned at a fixed distance on each side of said lower-side pressure cylinder and press punch, each of said vice sets comprising an upper-side pressure cylinder having an extendable piston and an opposed lower-side die arranged for axially closing and opening movement, each of said upper-side pressure cylinders and lower-side dies respectively including an upper and a lower vice plate arranged for cooperatively gripping said sheet metal strip extending therebetween upon closing movement of said vice set, said upper and lower vice plates being movable in a horizontal direction.

2. The apparatus of claim 1, wherein said press punch and lower-side pressure cylinder are arranged to cooperatively grip and deform said sheet metal strip extending therebetween in a vertical direction as said vice sets grip said sheet metal strip and move in a horizontal direction at positions laterally spaced from said press punch and lower-side pressure cylinder.

3. The apparatus of claim 2, wherein said upper-side pressure cylinder piston carries said upper vice plate, and said lower-side pressure cylinder includes a pressure plate.

4. The apparatus of claim 3, wherein said horizontal movement of at least one of said vice plates is provided by an adjustment cylinder attached to said vice plate.

5. The apparatus of claim 4, wherein said adjustment cylinder is a hydraulic cylinder.

6. The apparatus of claim 4, wherein said adjustment cylinder is arranged to provide back and forth movement of said vice plate in said horizontal direction.

7. The apparatus of claim 1, wherein each of said vice plates is mounted by means of a friction bearing arranged for horizontal movement of the vice plate.

8. The apparatus of claim 1, wherein at least one of said lower-side dies is arranged for movement in an axial direction perpendicular to said horizontal bed plate.

9. The apparatus of claim 1, wherein each of said lower-side dies, upper-side pressure cylinders and press punch is separately operable.

* * * * *